US008156907B2

(12) United States Patent
Fujii et al.

(10) Patent No.: US 8,156,907 B2
(45) Date of Patent: Apr. 17, 2012

(54) CAM HOUSING

(75) Inventors: Hiroki Fujii, Aichi (JP); Masahide Sakurai, Kariya (JP); Katsuhiko Motosugi, Toyota (JP); Naruhiko Nakashima, Aichi (JP)

(73) Assignee: Otics Corporation, Aichi (JP)

( * ) Notice: Subject to any disclaimer, the term of this patent is extended or adjusted under 35 U.S.C. 154(b) by 436 days.

(21) Appl. No.: 12/311,001

(22) PCT Filed: Sep. 19, 2007

(86) PCT No.: PCT/JP2007/068132

§ 371 (c)(1),
(2), (4) Date: Sep. 15, 2009

(87) PCT Pub. No.: WO2008/035695

PCT Pub. Date: Mar. 27, 2008

(65) Prior Publication Data

US 2010/0065012 A1 Mar. 18, 2010

(30) Foreign Application Priority Data

Sep. 19, 2006 (JP) ..... 2006-253417

(51) Int. Cl.
*F01M 9/10* (2006.01)

(52) U.S. Cl. ..... 123/90.38; 123/90.52; 123/195 C

(58) Field of Classification Search ..... 123/90.38, 123/90.52, 90.43, 90.44, 195 C, 195 R
See application file for complete search history.

(56) References Cited

U.S. PATENT DOCUMENTS 4,644,913 A * 2/1987 Stoody, Jr. ..... 123/90.46
4,941,438 A 7/1990 Muto
5,311,845 A 5/1994 Takahashi
6,199,525 B1 3/2001 Uema et al.

FOREIGN PATENT DOCUMENTS

| | | |
|---|---|---|
| DE | 100 41 975 | 3/2001 |
| DE | 100 40 119 | 2/2002 |
| EP | 0 552 369 | 7/1993 |
| EP | 0 907 007 | 4/1999 |

(Continued)

OTHER PUBLICATIONS

International Search Report mailed Nov. 27, 2007 for International Application No. PCT/JP2007/068132.

(Continued)

*Primary Examiner* — Zelalem Eshete
(74) *Attorney, Agent, or Firm* — Wenderoth, Lind & Ponack, L.L.P.

(57) ABSTRACT

A cam housing 3 in accordance with the present invention includes: a body portion 4 that is provided separately from a cylinder head 1, supports a camshaft 2 for driving a valve 10 provided in the cylinder head 1, and is fixed to the cylinder head 1; a sub housing 20 that includes a mounting concavity 21 for mounting a lash adjuster 18 and is fixed to the body portion 4 with a mounting face 20A thereof forced against an outer face of the body portion 4, the mounting face 20A being different from the face wherein an opening of the mounting concavity 21 is provided; and an air vent 22 that penetrates the sub housing 20 between a wall surface thereof and the mounting face 20A thereof and thereby is provided in the sub housing 20, the wall configuring an inner space formed in the mounting concavity wherein the lash adjuster 18 is mounted.

10 Claims, 4 Drawing Sheets

FOREIGN PATENT DOCUMENTS

| | | |
|---|---|---|
| GB | 2 224 326 | 5/1990 |
| JP | 61-186712 | 11/1986 |
| JP | 62-182409 | 8/1987 |
| JP | 62-42083 | 10/1987 |
| JP | 4-65904 | 6/1992 |
| JP | 5-288020 | 11/1993 |
| JP | 7-17765 | 4/1995 |
| JP | 11-166422 | 6/1999 |
| JP | 2004-36476 | 2/2004 |
| JP | 2005-002953 | 1/2005 |
| JP | 2006-161656 | 6/2006 |
| JP | 2006-194154 | 7/2006 |

OTHER PUBLICATIONS

Supplementary European Search Report dated Jun. 7, 2010 in corresponding European Application No. 07807519.9.

* cited by examiner

CAM HOUSING

TECHNICAL FIELD

The present invention relates to a cam housing that is assembled to a cylinder head.

BACKGROUND ART

Generally, a lash adjuster is configured to include a body and a plunger. The body is fixed to a mounting concavity of a cylinder head. The plunger can move up and down in this body. The plunger has an upper end portion protruding from the body, and this upper end portion of the plunger supports a rocker arm. A low-pressure chamber is provided in the plunger, while a high-pressure chamber is formed in the lower space of the body. The lower space is bounded by a bottom wall of the plunger. A valve port is opened in a bottom wall of the plunger, and a valve body is provided in the high-pressure chamber. The valve body is biased in a direction to close the valve port. The valve body can open and close the valve port.

Operation of the lash adjuster is as follows. As the plunger moves up at a time of starting the engine, the valve port accordingly opens so that oil in the low-pressure chamber is drawn into the high-pressure chamber. At this time, if the level of operating oil in the low-pressure chamber is low, the air in the low-pressure chamber can be drawn into the high-pressure chamber and can cause abnormal noise. As a countermeasure of this, there is an art that stores a large amount of operating oil in the low-pressure chamber in advance and thereby prevents drawing of the air into the high-pressure chamber. For example, Patent Document 1 as below discloses a lash adjuster that has an oil supply passage as a means for store the large amount of operating oil in the low-pressure chamber. In this art, operating oil is supplied through this oil supply passage substantially up to the oil level of the top end of the plunger so that the operating oil level in the low-pressure chamber is at the higher level.

[Patent Document 1] Japanese Unexamined Patent Application Publication 2005-2953

DISCLOSURE OF THE INVENTION

Problem to be Solved by the Invention

However, generally, an air vent is provided in a bottom face of the mounting concavity of the cylinder head. The air vent is used for releasing the air remaining in the mounting concavity when mounting the lash adjuster in the mounting concavity. Because this air vent is opened in the engine room, the operating oil stored in the low-pressure chamber flows into the engine room through the mounting concavity and further through the air vent when the engine is stopped for a long time. This causes fall of the operating oil level in the low-pressure chamber. As a result of this, the air in the lower pressure chamber side is drawn into the high-pressure chamber side and tends to cause abnormal noise at a time of starting the engine.

On the other hand, if the air vent is eliminated while a clearance between an outer periphery of the lash adjuster and an inner periphery of the mounting concavity is enlarged so that the remaining air is released from this clearance, a difficulty such as minute vibration is caused at a time of operating the lash adjuster. Thus, preventing flow of the operating oil from the mounting concavity to the engine room is a problem, while releasing the air remaining in the mounting concavity is another problem, and these problems conflict with each other.

The present invention was completed based on the circumstances as above, and its purpose is to prevent flow of the operating oil in the lash adjuster from flowing out into the engine room at a time of stopping the engine, while to enable to release the air remaining in the mounting concavity to the outside at a time of mounting the lash adjuster.

Means for Solving the Problem

The present invention is characterized by including: a body portion that is provided separately from a cylinder head, supports a camshaft for driving a valve provided in the cylinder head, and is fixed to the cylinder head; a sub housing that includes a mounting concavity for mounting a lash adjuster and is fixed to the body portion with a mounting face thereof forced against an outer face of the body portion, the mounting face being different from the face wherein an opening of the mounting concavity is provided; and an air vent that penetrates the sub housing between a wall surface thereof and the mounting face thereof and thereby is provided in the sub housing, the wall configuring an inner space formed in the mounting concavity wherein the lash adjuster is mounted.

With the above configuration, first, when mounting the lash adjuster in the mounting concavity, the air remaining in the mounting concavity is released to the outside through the air vent. This serves for reliably mounting the lash adjuster in the mounting concavity. Next, the sub housing is fixed to the body portion with the mounting face forced against the outer face of the body portion. As a result of this, the opening of the air vent is closed by the outer face of the body portion. This serves for preventing the operating oil in the lash adjuster from flowing out into the engine room. Thus, the problem of preventing the operating oil in the mounting concavity from flowing out and the problem of releasing the remaining air can be solved together.

Furthermore, the configuration may be also as follows.

An oil supply passage is formed in the sub housing, the oil supply passage being in communication with the mounting concavity and supplies operating oil to the lash adjuster. With this configuration, the oil supply passage can be formed in the sub housing. Therefore, it is unnecessary to provide the oil supply passage using another piping, and the oil passage and the mounting concavity can be integrally formed.

The camshaft includes an intake camshaft that drives an intake valve and an exhaust camshaft that drives an exhaust valve; the body portion includes a shaft attachment portion and a sub-housing attachment portion, the shaft attachment portion supporting the two camshafts, the sub-housing attachment portion protruding from a portion between the two camshafts; the sub housings are fixed to respective portions across the sub-housing attachment portion, each of the portions corresponding to respective one of the two camshafts; wherein a penetrating bypass passage is provided in the sub-housing attachment portion, the bypass passage being opened in the outer face of the sub-housing attachment portion, the mounting face is forced against the outer face; and the oil supply passages of the sub housings are in communication through the bypass passage.

With this configuration, operating oil can be supplied to both of the oil supply passages by supplying the operating oil to either one of the two oil supply passages that are in communication through the bypass passage.

A plurality of cylinders are formed in a cylinder block whereto the cylinder head is assembled; the sub housing is configured in one piece having a plurality of the mounting concavities concaved in positions corresponding to the respective cylinders; and the oil supply passage includes insertion passages and a connection passage, the insertion passages being connected to the respective mounting concavities, the connection passage connecting the insertion passage therebetween, and the oil supply passage being formed in the sub housing.

With this configuration, the connection passage, which connects the insertion passages that are connected with the respective mounting concavities, can be formed in the sub housing. Therefore, it is unnecessary to provide the connection passage using another piping, and the insertion passages and the connection passage can be integrally formed.

The mounting concavity has a round hole shape; a body that configures an outer periphery of the lash adjuster has a cylindrical shape having a bottom, and a bottom end portion of the body is arcuately bulged; and the lash adjuster can rotationally move in the mounting concavity with a surface of the bulged portion in point contact with a bottom face of the mounting concavity. With this configuration, the lash adjuster can keep contact with the rocker arm while rotationally moving with respect to the rocker arm at the time of starting the engine. This serves for preventing the lash adjuster and the rocker arm from sticking together as a result of localized contact therebetween.

Effect of the Invention

In accordance with the present invention, the problem of preventing the operating oil in the mounting concavity from flowing out and the problem of releasing the remaining air can be solved together.

EXPLANATION OF REFERENCE SYMBOLS

1 . . . cylinder head; 2 . . . camshaft; 2A . . . intake camshaft; 2B . . . exhaust camshaft; 3 . . . cam housing; 4 . . . body portion; 4A . . . shaft attachment portion; 4B . . . sub-housing attachment portion; 10 . . . intake valve; 11 . . . exhaust valve; 16 . . . cam; 18 . . . lash adjuster; 20 . . . sub housing; 20A . . . mounting face; 21 . . . mounting concavity; 22 . . . air vent; 23 . . . connection passage; 24 . . . insertion passage; and 34 . . . bypass passage

BEST MODE FOR CARRYING OUT THE INVENTION

First Embodiment

Figure 1:
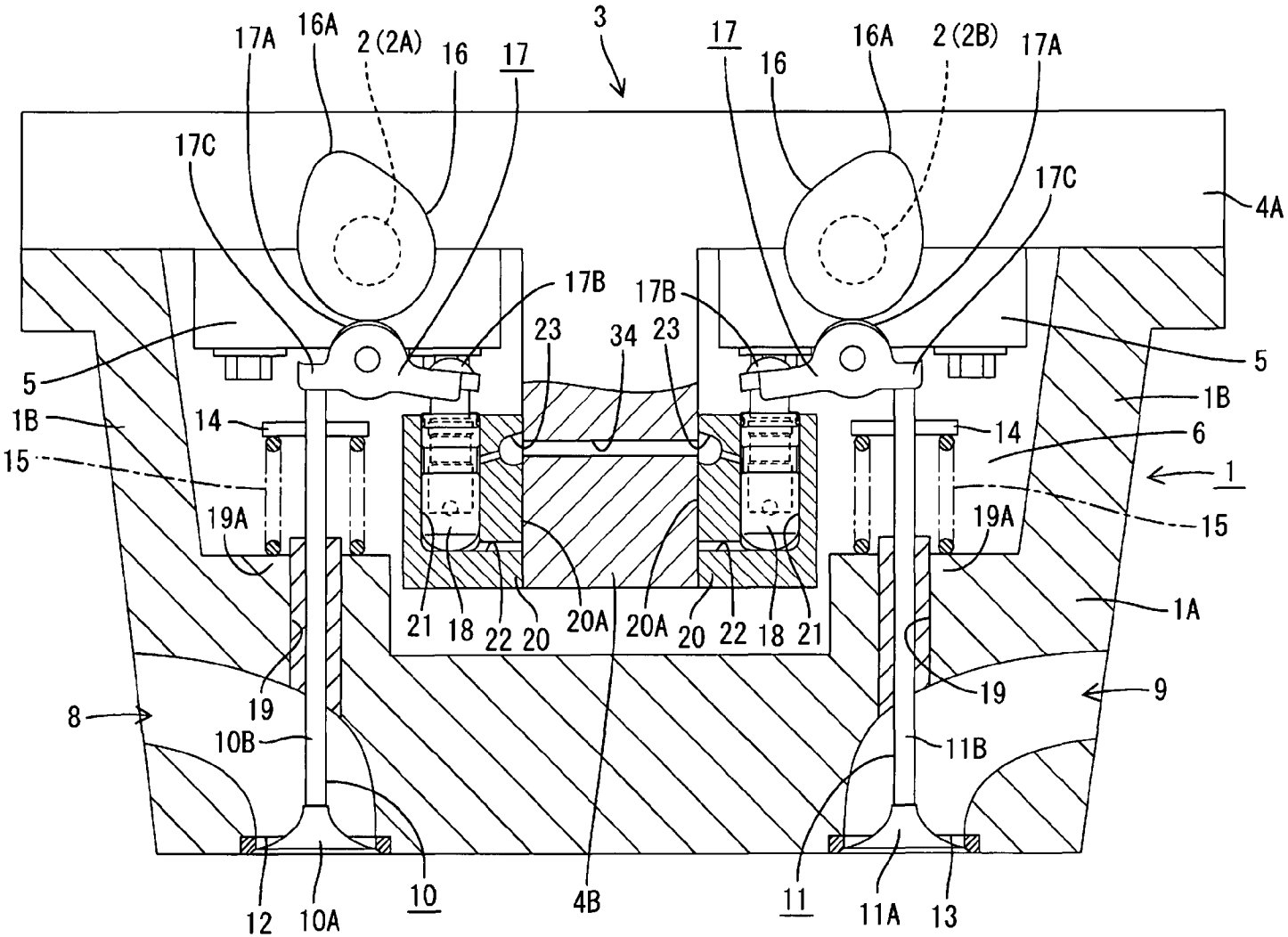
FIG. 1 is a cross-sectional view of a cylinder head of a first embodiment.
Figure 2:
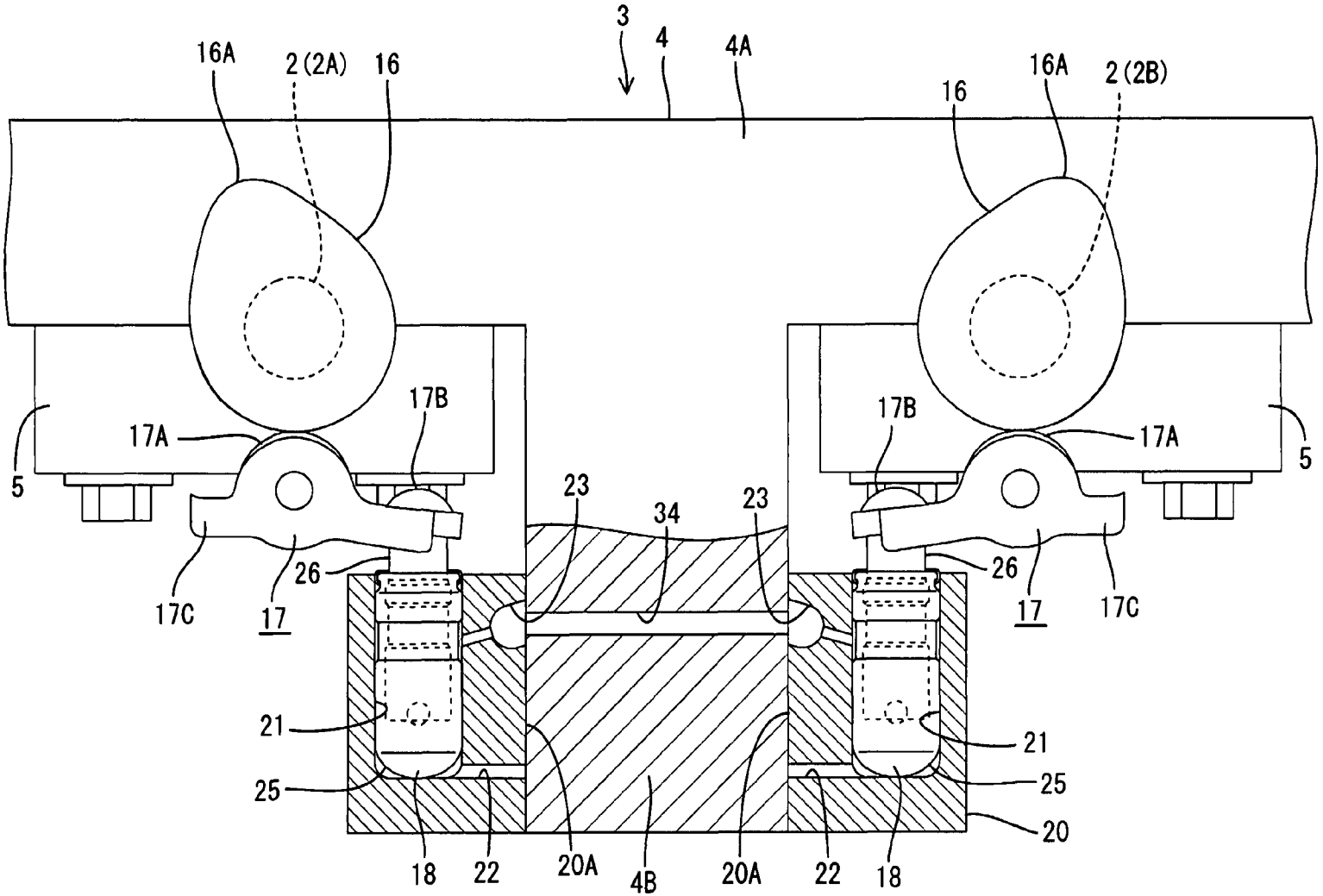
FIG. 2 is an enlarged cross-sectional view of a cam housing of the first embodiment.

A first embodiment in accordance with the present invention will be explained with reference to FIGS. 1 through 3. The engine of this embodiment is an automotive DOHC (double overhead camshaft) engine. The engine includes a cylinder head 1 and a cam housing 3. The cam housing 3 is provided separately from the cylinder head 1 and is fixed to the cylinder head 1. Camshafts 2 are rotatably supported by the cam housing 3. While a plurality of cylinders (not illustrated) are disposed in lines (in a direction perpendicular to the sheet in FIG. 1) in a top face of a cylinder block (not illustrated), the cylinder head 1 is bolted up to the top face of the cylinder block with a head gasket (not illustrated) in between and thereby is fixed thereto. This cylinder head 1 is configured by a valve accommodating portion 1A and outer walls 1B. Two valves 10, 11 are movably supported by the valve accommodating portion 1A, which will be described below. The outer walls 1B continuously stands from outer peripheral walls of the valve accommodating portion 1A.

The cam housing 3 has a substantially T-shaped body portion 4. The body portion 4 includes a shaft attachment portion 4A and a sub-housing attachment portion 4B. The shaft attachment portion 4A horizontally extends, while the sub-housing attachment portion 4B extends downward from the shaft attachment portion 4A. After the shaft attachment portion 4A is placed on a top end faces of the outer walls 1B with the sub-housing attachment portion 4B enclosed with the outer walls 1B, an accommodating space 6 is formed by a top face of the valve accommodating portion 1A, inner faces of the outer walls 1B, and bottom faces of the shaft attachment portion 4A.

Inlet passages 8 (illustrated on the left hand in the figure) and exhaust passages 9 (illustrated on the right hand in the figure) are opened in a bottom face of the valve accommodating portion 1A. Each of the intake passages 8 is in communication with respective one of the cylinders through an intake port 12, and an intake valve 10 is provided in the opening edge portion of the intake port 12. The intake valve 10 can open and close the intake port 12. Likewise, the exhaust passage 9 is in communication with another cylinder through an exhaust port 13, and an exhaust valve 11 is provided in the opening edge portion of the exhaust port 13. The exhaust valve 11 can open and close the exhaust port 13. Note that configurations of the two valves 10, 11 are identical and, therefore, the identical configurations will be explained with taking the intake valve 10 as a representative, which will hereinafter be referred to simply as the "valve 10".

The valve 10 is configured by a disc-shaped valve plug 10A and a stick-shaped valve stem 10B. A penetrating hole 19 is formed in the cylinder head 1. The accommodating space 6 is in communication with the intake passage 8 through the penetrating hole 19. A cylindrical valve guide 7 is assembled to the penetrating hole 19. The valve stem 10B is held by the valve guide 7 movably along the axial direction thereof in a oil-sealed state. The top end of the valve stem 10B penetrates the valve guide 7 and projects in the accommodating space 6. A disc-shaped spring plate 14 is secured slightly below the top end of the valve stem 10B. On the other hand, the top face of the cylinder head 1 has an opening edge portion of the penetrating hole 19, and this portion serves as a spring seat portion 19A. A valve spring 15 is assembled in a compressed state between the spring plate 14 and the spring seat portion 19A. The valve plug 10A of the valve 10 is biased by the spring force of this valve spring 15 so as to close the intake port 12 in a normal state.

A bearing piece 5 is bolted up to one of the bottom faces of the shaft attachment portion 4A of the body portion 4 and thereby is fixed thereto. A bearing bore (not illustrated) is formed in a mating face between the bottom face of the shaft attachment portion 4A and a top face of the bearing pieces 5. The camshafts 2 are rotatably supported by the respective bearing bores. The camshafts 2 include an intake camshaft 2A (illustrated on the left hand in the figure) and an exhaust camshaft 2B (illustrated on the right hand in the figure). The camshafts 2A, 2B are disposed in parallel and form a pair. Note that configurations of the two camshafts 2A, 2B are identical and, therefore, the identical configurations will be explained with taking the intake camshaft 2A as a representative, which will hereinafter be referred to simply as the "camshaft 2". The camshaft 2 has a plurality of cams 16 arranged in the axial direction thereof. Each one of the cams 16 is disposed in a position corresponding to respective one of the cylinders. Each cam 16 has a cam rob 16A protruding in one direction from the center of the shaft of the camshaft 2.

A rocker arm 17 is disposed between the valve 10 and the cam 16. The rocker arm 17 includes a receiving face 17B for a lash adjuster 18, which will be described below, and a valve contacting point 17C. The receiving face 17B and the valve contacting point 17C each are disposed in opposite sides across a rotating portion 17A. The rotating portion 17A is constantly in a state contacting the cam 16 and can rotate following rotational movement of the cam 16. While a predetermined valve clearance is set between the valve contacting point 17C and the top end of the valve stem 10B when the valve 10 is closed, the lash adjuster 18 automatically adjusts the valve clearance, so that the valve contacting point 17C and the top end of the valve stem 10B is constantly in contact with each other. Thus, the rocker arm 17 is configured such that the valve contacting point 17C swings and is displaced about the receiving face 17B, so that the rocker arm 17 can convert the rotational movement of the cam 16 into reciprocating movement and cause the valve 10 to perform open-close operation via the valve contacting point 17C.

Though the camshaft 2 is illustrated as a solid shaft to simplify the drawings, the camshaft 2 is a hollow shaft in practice, and operating oil has been poured into its inside. The camshaft 2 has a portion opposing to the bearing piece 5, and this portion has an operating-oil supply port opened therein. Operating oil, which is circulated in the engine room by an oil pump (not illustrated), is supplied from this supply port. The operating oil supplied from this supply port forms an oil layer on the outer periphery of the camshaft 2, so that smooth rotational operation is realized. Furthermore, an oil passage (not illustrated) of the operating oil circulating in the engine room partially runs above the camshaft 2. An opening is provided in this oil passage at a position corresponding to the cam 16. The operating oil is suitably supplied through this opening toward the cam 16. Thus, an oil layer is formed on the outer periphery of the cam 16, and this oil layer serves for preventing the cam 16 from sticking to the rocker arm 17 and serves for cooling them.

Two sub housings 20 are bolted up to respective (right and left) sides across the sub-housing attachment portion 4B and are fixed thereto. Each of the sub housings 20 has an outer face which is different from the face wherein the opening of mounting concavities 21 is provided and is a face whereagainst respective one of an outer faces of the sub-housing attachment portion 4B is forced. This outer face is a mounting face 20A. Each of the sub housings 20 of this embodiment is configured in one piece. Each of the sub housings 20 has positions corresponding to the respective cylinders, and the plurality of mounting concavities 21 are concaved in these positions. Each of the mounting concavities 21 is a round hole having a bottom. The lash adjusters 18 are mounted in these mounting concavities 21.

An oil supply passage is disposed in each of the sub housing 20. The oil supply passage includes insertion passages 24 and a connection passage 23. Each of the insertion passages 24 is connected to respective one of the mounting concavities 21. The connection passage 23 connects the insertion passages 24 therebetween. An end portion of the connection passage 23 is connected to the above-described oil passage. The mounting face 20A side of the inner wall of the connection passage 23 is bored, and thus the connection passage 23 is exposed to the outside. The bored portion of the connection passage 23 is closed by fixing the mounting face 20A to the outer face of the sub-housing attachment portion 4B. That is, the outer face of the sub-housing attachment portion 4B configures a part of the inner wall face of the connection passage 23. The connection passage 23 is in communication with the mounting concavities 21 through the insertion passages 24, so that the operating oil supplied from the oil passage to the connection passage 23 can be supplied to the mounting concavities 21.

Bypass passages 34 that penetrate the sub-housing attachment portion 4B in the widthwise direction are formed at a level that corresponds to the connection passages 23. While the sub-housing attachment portion 4B has outer faces whereagainst the respective mounting faces 20A are forced, each of the bypass passages 34 is opened in these outer faces. The connection passages 23 of the respective sub housings 20, which are disposed on the two sides across the sub-housing attachment portion 4B, are in communication with each other through the bypass passages 34. Thus, operating oil can be supplied to both of these two connection passages 23 by connecting the end portion of either one of the two connection passages 23 with the oil passage.

Figure 3:
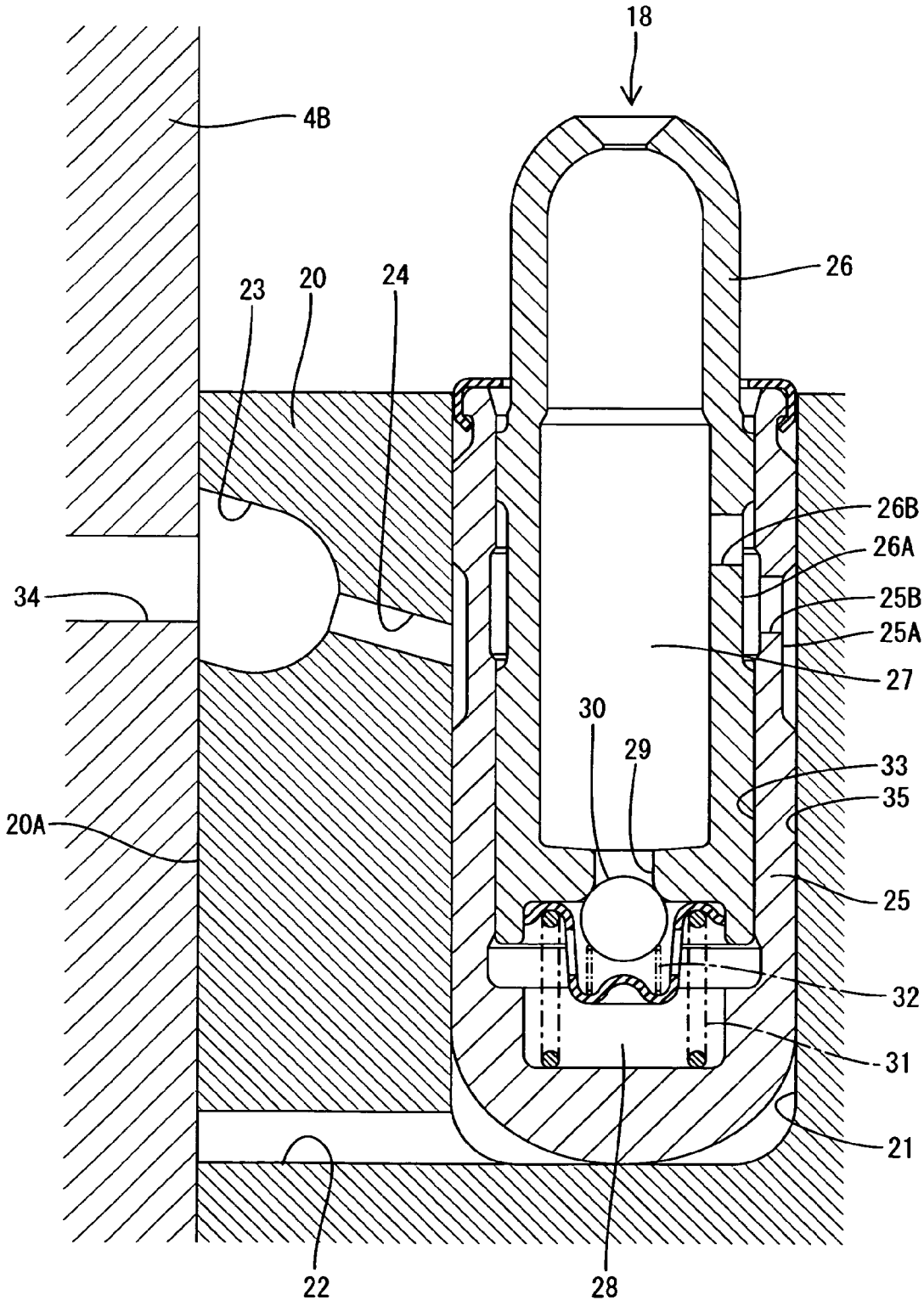
FIG. 3 is an enlarged cross-sectional view of a sub housing of the first embodiment.

As shown in FIG. 3, each of the lash adjusters 18 includes a body 25 and a plunger 26. The body 25 has cylindrical shape having a bottom. The plunger has a hollow structure and can move up and down inside the body 25. The outside diameter of the body 25 is set at equal to or slightly smaller than the inner diameter of the mounting concavity 21. Operating oil penetrates between an outer periphery of the body 25 and an inner periphery of the mounting concavity 21, and thus the body 25 can rotate inside the mounting concavity 21. The outer periphery of the body 25 has a first narrow portion 25A provided therearound by narrowing the diameter of the outer periphery of the body 25 in the radially inward direction. The level of the first narrow portion 25A corresponds to the insertion passage 24. A first communication passage 25B is penetratingly formed between outer and inner peripheries of the first narrow portion 25A. The outer and the inner peripheral sides of the first narrow portion 25A are in communication with each other through the first communication passage 25B. Furthermore, a bottom end portion of the body 25 is arcuately bulged so that the surface of this bulged portion makes point contact with the bottom face of the mounting concavity 21. Therefore, there is no possibility for the lash adjuster 18 to be blocked from rotation by contact resistance between the bottom end portion of the body 25 and the bottom face of the mounting concavity 21.

A low-pressure chamber 27 is formed in the plunger 26, and a ceiling wall that configures the low-pressure chamber 27 is penetrated by a supply opening. The receiving face 17B of the rocker arm 17 is supplied with operating oil from this supply opening. On the other hand, a high-pressure chamber 28 is formed inside the body 25. The high-pressure chamber 28 is separated from the low-pressure chamber 28 by a bottom wall that configures the low-pressure chamber 28. A valve port 29 is penetratingly formed in the bottom wall that configures the low-pressure chamber 27, and the high-pressure chamber 28 is in communication with the low-pressure chamber 27 through the valve port 29. A spherical check ball 30 and two (large and small) kinds of springs 31, 32 are disposed in the high-pressure chamber 28. Note that the valve port 29 has an opening edge portion at the high-pressure chamber 28 side, and the check ball 30 is biased at this opening edge portion by the two springs 31, 32 in the direction to close the valve port 29. Detailed explanation of these structures is herein omitted.

A second narrow portion 26A is provided around the outer periphery of the plunger 26 by narrowing the diameter of the plunger 26 in the radially inward direction at the level that corresponds to the first communication passage 25B. A second communication passage 26B is penetratingly formed between outer and inner peripheries of the second narrow portion 26A. The outer and the inner peripheral sides of the second narrow portion 26A are in communication with each other through the second communication passage 26B. Thus, operating oil can be supplied into the low-pressure chamber 27 through the insertion passage 24, the first narrow portion 25A, the first communication passage 25B, the second narrow portion 26A, and the second communication passage 26B. Furthermore, the operating oil in the low-pressure chamber 27 can be supplied into the high-pressure chamber 28 through the valve port 29: when the plunger 26 moves up, the inside of the high-pressure chamber 28 becomes lower in pressure than the inside of the low-pressure chamber 27, so that the operating oil flows from the low-pressure chamber 27 to the high-pressure chamber 28 through the valve port 29; while, when the plunger 26 moves down, the valve port 29 is closed by the check ball 30, while the operating oil in the high-pressure chamber 28 leaks into the second narrow portion 26A through a clearance 33 between the outer periphery of the plunger 26 and the inner periphery of the body 25.

Note that each of the mounting concavity 21 has a bottom face side on the inner periphery thereof, and an air vent 22 is penetratingly formed in this bottom face side toward the sub-housing attachment portion 4B. When mounting the lash adjuster 18 in the mounting concavity 21, this air vent 22 serves for releasing the air remaining, in the mounting concavity 21, between the bottom end portion of the body 25 and the bottom face of the mounting concavity 21 to the outside. Then, after the lash adjuster 18 is mounted in the mounting concavity 21, the sub housing 20 is fixed to the sub-housing attachment portion 4B, and thus the opening of the air vent 22 is closed by the outer face of the sub-housing attachment portion 4B. Therefore, even if operating oil enters the air vent 22 through a clearance 35 between the outer periphery of the body 25 and the inner periphery of the mounting concavity 21, leak of the operating oil from the air vent 22 to the outside is restricted. As a result of this, there is no possibility for the level of the operating oil stored in the low-pressure chamber 27 to go down even when the engine is stopped for a long time. Furthermore, there is no possibility for the air to be drawn from the low-pressure chamber 27 side to the high-pressure chamber 28 side and to cause abnormal noise at a time of starting the engine.

The structure of this embodiment is as explained above. Next, the operation will be explained.

First, the lash adjusters 18 are mounted in the mounting concavities 21 of the sub housings 20. Here, because the air remaining in the mounting concavities 21 is released to the outside through the air vents 22, the lash adjusters 18 can be reliably inserted to the bottom faces of the mounting concavities 21. After the lash adjusters 18 are mounted in the mounting concavities 21, the sub housings 20 are bolted up to the sub-housing attachment portion 4B of the body portion 4 and thereby are fixed thereto. Thus, the bored portions of the connection passages 23 are closed by the outer faces of the sub-housing attachment portion 4B. Along with this, the intake-side connection passages 23 are in communication with the respective exhaust-side connection passages 23 by the bypass passages 34. As a result of this, operating oil can be supplied to both of these two connection passages 23 by connecting the end portion of either one of the connection passages 23 with the oil passage.

Furthermore, because the openings of the air vents 22 are closed by the outer faces of the sub-housing attachment portion 4B, leak of the operating oil from these air vents 22 to the outside does not occur even if, while the engine is stopped, the operating oil stored in the low-pressure chambers 27 flows through the second communication passages 26B, the second narrow portions 26A, and the first communication passages 25B into the first narrow portions 25A; and, further, flows out into the air vents 22 through the clearances 35 between the outer peripheries of the bodies 25 and the inner peripheries of the mounting concavities 21. Therefore, even if the engine is stopped for a long time, oil-level down of the operating-oil in the low-pressure chambers 27 does not occur. This serves for preventing the air from being drawn into the high-pressure chambers 28 and from generating abnormal noise at the time of starting the engine.

As described above, effects as following can be obtained with this embodiment:

1. First, when mounting the lash adjusters 18 in the mounting concavities 21, the lash adjusters 18 can be reliably mounted in the mounting concavities 21 by releasing the air remaining in the mounting concavities 21 to the outside through the air vents 22. Next, the sub housings 20 are fixed to the body portion 4 with the mounting faces 20A forced against the outer faces of the body portion 4. As a result of this, the openings of the air vents 22 are closed by the outer faces of the body portion 4, and thereby the operating oil in the low-pressure chambers 27 is prevented from flowing out into the engine room. Thus, a problem of preventing the operating oil from flowing out of the mounting concavities 21 and a problem of releasing the air remaining in the mounting concavities 21 can be solved together.

2. The oil supply passages (the insertion passages 24) can be formed in the sub housings 20. Therefore, it is unnecessary to provide each oil supply passage using another piping, and the oil supply passages (the insertion passages 24) and the mounting concavities 21 can be integrally formed.

3. The two connection passages 23 are in communication with each other through the bypass passages 34, and both of the two connection passages 23 can be supplied with operating oil by connecting the end portion of either one of the two connection passages 23 with the oil passage and supplying the operating oil therethrough.

4. The mounting concavities 21 are in communication with the respective insertion passages 24; the insertion passages 24 are connected by the connection passages 23; and the connection passages 23 can be formed in the respective sub housings 20. Therefore, it is unnecessary to provide each connection passage 23 using another piping; the insertion passages 24 and the connection passage 23 can be integrally formed.

5. At the time of starting the engine, the lash adjusters 18 can keep contact with the rocker arms 17 while rotationally moving with respect to the rocker arms 17. This serves for preventing the lash adjuster 18 from making localized contact with the rocker arm 17 and causing abrasion sticking thereto.

Second Embodiment

Figure 4:
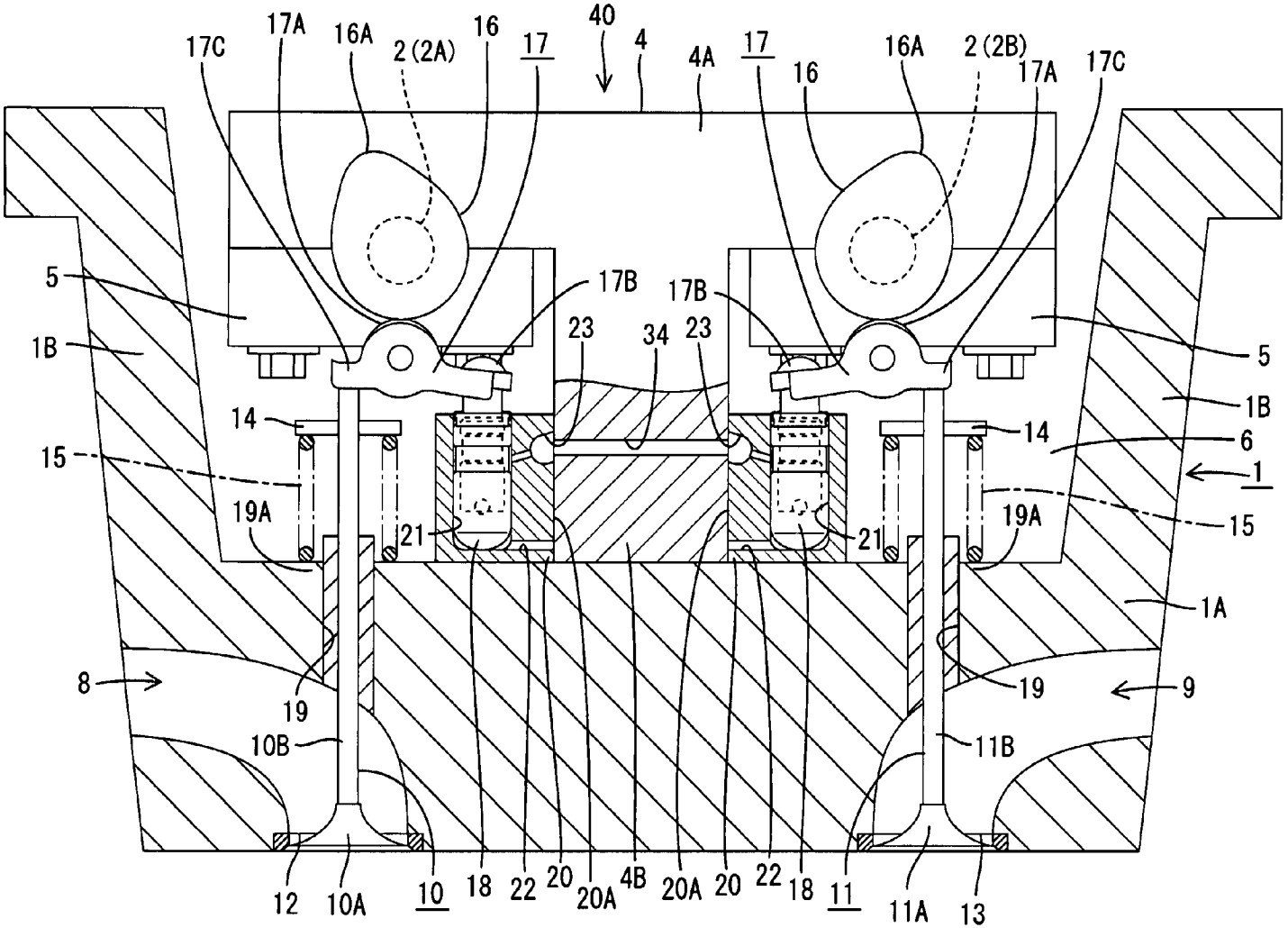
FIG. 4 is a cross-sectional view of a cylinder head of a second embodiment.

Next, a second embodiment in accordance with the present invention will be explained with reference to FIG. 4. A cam housing 40 of this embodiment has a partially modified structure with respect to the body portion 4 of the first embodiment. Explanation concerning portions identical with those of the first embodiment will be omitted. The cam housing 40 of this embodiment has a portion that corresponds to the shaft attachment portion 4A, while this portion is accommodated inside the outer walls 1B. Accordingly, the bottom face of the sub-housing attachment portion 4B is placed on the top face of the valve accommodating portion 1A and is bolted up and thereby is fixed thereto. This allows a head cover (not illustrated) to be attached directly to the top end faces of the outer walls 1B, and thus the number of sealed faces can be reduced than a case where the head cover is attached with the cam housing 3 in between as done in the first embodiment. Therefore, sealing performance can be higher.

Note that the present invention is not limited to the embodiments described above with reference to the drawings; for example, the following embodiments are also included within the scope of the present invention.

(1) In the above embodiments, the connection passages 23 are formed illustratively in the respective sub housings 20. In accordance with the present invention, the connection passages 23 may be provided in the sub-housing attachment portion 4B.

(2) In the above embodiments, the DOHC type including the intake and the exhaust camshafts 2A, 2B is illustrated. In accordance with the present invention, the number of the camshafts 2 is not limited; for example, the type may be SOHC (single overhead camshaft).

The invention claimed is:

1. A cam housing comprising:

a body portion that is provided separately from a cylinder head, supports a camshaft for driving a valve provided in the cylinder head, and is fixed to the cylinder head;

a sub housing that includes a mounting concavity for mounting a lash adjuster and is fixed to the body portion with a mounting face thereof forced against an outer face of the body portion, the mounting face being different from the face wherein an opening of the mounting concavity is provided; and an air vent that penetrates the sub housing between a wall surface thereof and the mounting face thereof and thereby is provided in the sub housing, the wall configuring an inner space formed in the mounting concavity wherein the lash adjuster is mounted.

2. The cam housing according to claim 1, wherein an oil supply passage is formed in the sub housing, the oil supply passage being in communication with the mounting concavity and supplies operating oil to the lash adjuster.

3. The cam housing according to claim 2, wherein: the camshaft includes an intake camshaft that drives an intake valve and an exhaust camshaft that drives an exhaust valve; the body portion includes a shaft attachment portion and a sub-housing attachment portion, the shaft attachment portion supporting the two camshafts, the sub-housing attachment portion protruding from a portion between the two camshafts; the sub housings are fixed to respective portions across the sub-housing attachment portion, each of the portions corresponding to respective one of the two camshafts; wherein a penetrating bypass passage is provided in the sub-housing attachment portion, the bypass passage being opened in the outer face of the sub-housing attachment portion, the mounting face is forced against the outer face; and the oil supply passages of the sub housings are in communication through the bypass passage.

4. The cam housing according to claim 2, wherein: a plurality of cylinders are formed in a cylinder block whereto the cylinder head is assembled; the sub housing is configured in one piece having a plurality of the mounting concavities concaved in positions corresponding to the respective cylinders; and the oil supply passage includes insertion passages and a connection passage, the insertion passages being connected to the respective mounting concavities, the connection passage connecting the insertion passage therebetween, and the oil supply passage being formed in the sub housing.

5. The cam housing according to claim 1, wherein: the mounting concavity has a round hole shape; a body that configures an outer periphery of the lash adjuster has a cylindrical shape having a bottom, and a bottom end portion of the body is arcuately bulged; and the lash adjuster can rotationally move in the mounting concavity with a surface of the bulged portion in point contact with a bottom face of the mounting concavity.

6. The cam housing according to claim 3, wherein: a plurality of cylinders are formed in a cylinder block whereto the cylinder head is assembled; the sub housing is configured in one piece having a plurality of the mounting concavities concaved in positions corresponding to the respective cylinders; and the oil supply passage includes insertion passages and a connection passage, the insertion passages being connected to the respective mounting concavities, the connection passage connecting the insertion passage therebetween, and the oil supply passage being formed in the sub housing.

7. The cam housing according to claim 2, wherein: the mounting concavity has a round hole shape; a body that configures an outer periphery of the lash adjuster has a cylindrical shape having a bottom, and a bottom end portion of the body is arcuately bulged; and the lash adjuster can rotationally move in the mounting concavity with a surface of the bulged portion in point contact with a bottom face of the mounting concavity.

8. The cam housing according to claim 3, wherein: the mounting concavity has a round hole shape; a body that configures an outer periphery of the lash adjuster has a cylindrical shape having a bottom, and a bottom end portion of the body is arcuately bulged; and the lash adjuster can rotationally move in the mounting concavity with a surface of the bulged portion in point contact with a bottom face of the mounting concavity.

9. The cam housing according to claim 4, wherein: the mounting concavity has a round hole shape; a body that configures an outer periphery of the lash adjuster has a cylindrical shape having a bottom, and a bottom end portion of the body is arcuately bulged; and the lash adjuster can rotationally move in the mounting concavity with a surface of the bulged portion in point contact with a bottom face of the mounting concavity.

10. The cam housing according to claim 6, wherein: the mounting concavity has a round hole shape; a body that configures an outer periphery of the lash adjuster has a cylindrical shape having a bottom, and a bottom end portion of the body is arcuately bulged; and the lash adjuster can rotationally move in the mounting concavity with a surface of the bulged portion in point contact with a bottom face of the mounting concavity.

* * * * *